United States Patent [19]

Hallier, Jr.

[11] Patent Number: 4,772,220

[45] Date of Patent: Sep. 20, 1988

[54] CLIP/BRACKET FOR TRAILER WIRING CONNECTOR

[76] Inventor: Martin J. Hallier, Jr., 96 Highland Ave., Branford, Conn. 06405

[21] Appl. No.: 119,589

[22] Filed: Nov. 12, 1987

[51] Int. Cl.[4] ..... H01R 13/60

[52] U.S. Cl. ..... 439/528; 439/533

[58] Field of Search ..... 439/35, 528, 533; 248/309.1, 314

[56] References Cited

U.S. PATENT DOCUMENTS

| | | | |
|---|---|---|---|
| 2,474,899 | 7/1949 | Hutt | 248/314 X |
| 3,176,257 | 3/1965 | Introvigne | 439/528 |
| 3,577,115 | 5/1971 | Whitright | 439/528 |

*Primary Examiner*—Eugene F. Desmond

*Attorney, Agent, or Firm*—DeLio & Associates

[57] ABSTRACT

A clip for receiving and retaining a plug having means for securing the same to a support and including a back wall, side walls with surfaces shaped and spaced to engage sides of the plug, the side walls having top and bottom flanges and a slanted wall surface extending between said flanges.

4 Claims, 1 Drawing Sheet

CLIP/BRACKET FOR TRAILER WIRING CONNECTOR

Figure 1:
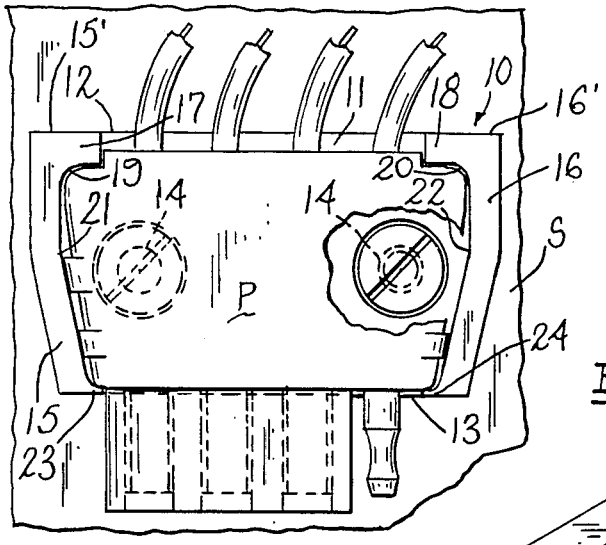

This invention relates to a clip or bracket to be mounted adjacent a trailer hitch for receiving and holding the plug or socket element of the electrical system connection between a trailer and a towing vehicle.

BACKGROUND

A trailer, of any size and design, is generally required to be provided with such feature as one or more tail lights and brake signals, connected to and synchronized with the corresponding elements of the towing vehicle. Since trailers must be detachable, permanent wiring between the trailer and the towing vehicle cannot be installed and it is common practice to terminate the upstream ends of the trailer light wires in a 3- or 4-wire plug or socket element, for separable connection to a complementary element wired to the electrical system of the towing vehicle. The wires on both sides of such a connection are necessarily unsupported for substantial distances unless wrapped around parts of the trailer or towing vehicle, so that the plug and socket may dangle below the hitch in a vulnerable position.

When a trailer is not connected to a towing vehicle, its light wires and their plug or socket need restraint and support to keep them clean and safe, ready for use when the trailer is to be towed. An expedient commonly resorted to is the securement of loose wires to the trailer tongue by means of an electrical tape or the like.

A more cumbersome and expensive expedient involves the provision of a socket fitted in a hole drilled in the trailer tongue, the wires and the trailer circuits being connected to terminals in the socket, the corresponding wires from the towing vehicle terminating in a complementary plug which is engaged with the trailer tongue socket when the trailer is being towed.

OBJECT OF THE INVENTION

It is accordingly an object of the invention to provide a clip or bracket which can be rigidly mounted on the tongue or other forward part of the trailer, or on the rear portion of the towing vehicle, for receiving the plug or socket, in order to retain the corresponding wires in a safe and convenient position.

It is a further object of the invention to provide such a clip or bracket which is shaped to receive a 3- or 4-wire plug or socket, and to hold it securely but releasably.

It is yet another object to provide a device which can readily be manufactured and installed.

It is still another object of the invention to make certain improvements in the form, dimensions and arrangement of the several elements of the clip by which the above named and other objects may effectively be attained.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

The clip or bracket hereinafter referred to as "clip" embodying this invention comprises a unitary part, preferably molded from a suitable rigid plastic material, having a rear wall which provides a mounting surface and end walls so spaced and shaped as to engage frictionally the opposite side edges of a standard trailer wire connector plug.

Figure 2:
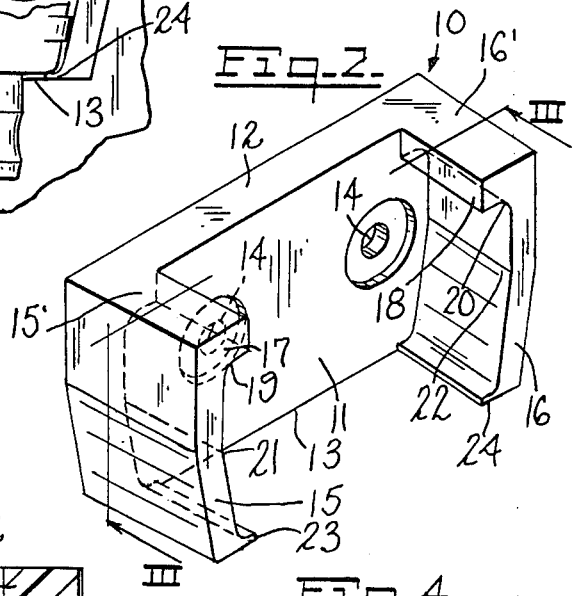
Figure 3:
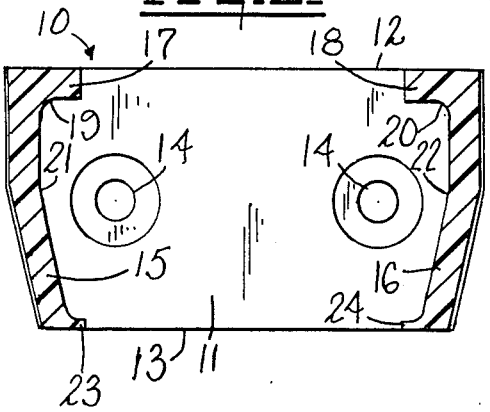
Figure 4:
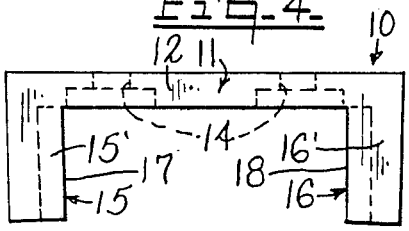

For a fuller understanding of the invention, reference is had to the following description taken in connection with the accompanying drawing, in which:

FIG. 1. is, on an enlarged scale, a front elevational view of the clip, attached to a trailer tongue (broken away), in the customary vertical position;

FIG. 2., is an orthographic projection of the clip shown in FIG. 1;

FIG. 3., is a vertical sectional view, taken on the line III—III on FIG. 2;

FIG. 4., is a top plan view of the clip; and

Figure 5:
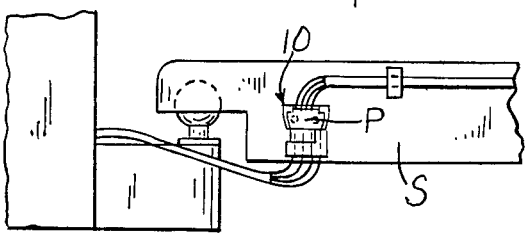

FIG. 5., is, on a smaller scale, an elevational view of the wire connection between a trailer and a towing vehicle, in the area of the trailer hitch.

Referring to the drawings, the clip 10 will be described, with reference to its preferred installed position, shown in FIG. 1, wherein the plug P is held with its active end downward, for proper drainage. The clip is formed with a flat back wall 11 having parallel top and bottom edges 12 and 13 and is provided with two screw holes 14 for attachment of the clip to a support S, such as a side surface of a trailer tongue.

Side walls 15 and 16 project forwardly from each end of the back wall 11, the top edges 15 and 16 of the side walls being coplanar with the edge 12 and the facing surfaces of the side walls being shaped and spaced to engage firmly the opposite side edges of a standard wiring plug element. Each side wall is formed with a strong flange 17 and 18 (FIG. 3) adjacent its top edge, the bottom of each flange merging in an arcuate curve 19 and 20 into a slightly slanted wall surface 21 and 22, which terminates downwardly in a smaller flange 23 and 24. The spacing of the flanges 17 and 18 from flange 23 and 24 is calculated to correspond to the body height of a standard wire connection plug P just as the shape and spacing of the side walls 15 and 16 from each other correspond to the lateral dimensions of the plug, so that a tight friction fit of the plug in the clip is assured. The distance between flanges 23 and 14 is less than the spacing of the walls at the points of merger with the arcuate curves 19 and 20. Such connecting plugs are normally slightly elastomeric and can be forced into tight engagement with the interior surfaces of the clip, preventing accidental displacement. The clip is essentially open-faces, engaging only the side edges of the connector plug.

While FIG. 5 shows the mounting of a clip on the trailer tongue, it will be understood that a clip may also be mounted on the bumper or other convenient surface of the towing vehicle, for retaining a plug or the like in a safe portion when no trailer is attached, or when the trailer tongue has no clip and the complete wiring system connection can be mounted on the towing vehicle instead of on the trailer tongue.

The connector elements customarily used with trailer wiring systems normally provide terminal for three (3) light wires and a ground wire, entering through a top edge of the plug and connected to terminals which are accessible through an opposite edge, with arrangement of the male and female terminals which enables the user to tell at a glance which is which, as exemplified in the lower portion of FIG. 1. When a complementary connecting element is engaged with the plug P, its upper edge fits tightly against the bottom end of plug P and makes a practically water-proof joint.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What I claim is:

1. A clip for receiving and retaining a plug or socket connector element of a trailer electrical system comprising, a substantially flat back wall portion, means for securing the back wall portion to a support, side walls integral with the back wall and having facing surfaces shaped and spaced to engage firmly the opposite side edges of a wiring plug element, each side wall having a laterally projecting top flange, a laterally projecting bottom flange, and a slanted wall surface extending between said flanges.

2. A clip according to claim 1 wherein the flat back wall portion has parallel top and bottom edges and the side walls have top edges which are coplanar with the top edge of the back wall portion.

3. A clip according to claim 1 wherein each side wall top flange has a bottom which merges in an arcuate curve with the top of an adjacent slanted wall surface.

4. A clip according to claim 3 wherein the spacing of the bottom flanges from each other is less than the spacing of the wall surfaces at their respective lines of merger with the arcuate curves.

* * * * *